US005197407A

United States Patent [19]

Sims

[11] Patent Number: 5,197,407

[45] Date of Patent: Mar. 30, 1993

[54] SECURITY DEVICE FOR ATTACHMENT TO THE RAILS A MOVABLE DOOR OR WINDOW

[75] Inventor: James K. Sims, Scottsdale, Ariz.

[73] Assignee: Emma A. MacDowell, Scottsdale, Ariz., rt interest

[21] Appl. No.: 866,425

[22] Filed: Apr. 10, 1992

[51] Int. Cl.[5] ..... G08B 13/08

[52] U.S. Cl. ..... 116/86; 116/112; 222/39

[58] Field of Search ..... 116/85, 86, 100, 137 R; 222/398, 39

[56] References Cited

U.S. PATENT DOCUMENTS

| | | | |
|---|---|---|---|
| 1,367,651 | 2/1921 | Ashley . | |
| 1,428,189 | 9/1922 | Stinzing . | |
| 2,904,223 | 9/1959 | Ryan | 222/162 |
| 3,299,960 | 1/1967 | Stern . | |
| 3,690,286 | 9/1972 | Gantt . | |
| 3,695,212 | 10/1972 | Gantt . | |
| 3,804,053 | 4/1974 | Gray . | |
| 4,018,361 | 4/1977 | Fegley | 222/162 X |
| 4,024,830 | 5/1977 | Fegley et al. . | |
| 4,166,428 | 9/1979 | Freeman et al. . | |
| 4,478,168 | 10/1984 | Wimmer . | |
| 4,722,461 | 2/1988 | Symmank | 222/397 X |

*Primary Examiner*—Daniel M. Yasich

*Attorney, Agent, or Firm*—Warren F. B. Lindsley

[57] ABSTRACT

A security device in the form of a combination door or window stop comprising a housing for containing a canister of gas under pressure, a valve mechanism for releasing the gas through a sound generator upon unauthorized movement of an associated door or window, and means for selectively clamping the housing on the rail of the door or window.

5 Claims, 1 Drawing Sheet

SECURITY DEVICE FOR ATTACHMENT TO THE RAILS A MOVABLE DOOR OR WINDOW

BACKGROUND OF THE INVENTION

This invention relates to a burglar alarm for detecting the unauthorized opening of a door or window in a building. More particularly, the invention relates to a casing or housing for readily mounting on the frame of a sliding door or window containing a pressurized container which upon movement of the door or window against it causes gas under pressure to be discharged from the container through a sound emitting diaphragm valve thereby providing an audible alarm upon actuation by an unauthorized person.

Various alarm and locking systems for doors and windows involve elaborate locks and usually electronic alarm systems to resist entry and to raise alarm of such attempts. Such systems are static and cannot be utilized on other doors.

The disclosed invention is directed to a simple and mobile alarm that resists entry and provides a piercing alarm without reliance on an external power system.

DESCRIPTION OF THE PRIOR ART

Gas operating audible alarms or warning devices are known. However, a gas operated device comprising a self contained housing for mounting on a door or window rail is not known.

U.S. Pat. No. 3,804,053 discloses a security device in the form of a combination alarm and door or window stop comprising a container of a pressurized gas combined with sound generator. The device is secured at one end to the movable surface of a door or window and is supported at its other end on a fixed surface so that if an unauthorized opening is attempted the sound generator will move slightly to release the pressurized gas from the container so as to cause an alarm sound to be generated.

U.S. Pat. No. 4,478,168 discloses a door brace alarm apparatus for resisting movement of a door and for providing a sound alarm when movement of the door is attempted.

U.S. Pat. No. 1,428,189 discloses an alarm whistle for a closure device. This device is attached to the guides of a sliding door or window.

Other patents of general interest that utilize some form of gas under pressure for actuating an alarm are set forth below, however, none are believed to anticipate the invention claimed herein: 1,367,561; 3,695,212; 3,299,906; 4,024,830; 3,690,286; 4,166,428.

SUMMARY OF THE INVENTION

In accordance with the invention claimed, a new and improved gas actuated burglar alarm is disclosed the housing of which is track mounted on the rails of doors or windows of a building and contains a pressurized gas canister, valve actuator and a sound generator all mounted in a small compact container that is adjustably affixed at one of a number of positions along the rail.

It is, therefore, one object of this invention to provide a new and improved simple and mobile burglar alarm.

Another object of this invention is to provide a novel security device in which the elements providing an alarm also function to prevent the unauthorized opening of a door or window.

A further object of this invention is to provide a novel security device which is relatively compact and light enough so as to be portable and yet is sufficiently strong so as to prevent unauthorized entering to a room.

A still further object of this invention is to provide a novel security device which is economical to make so that the cost to the purchaser is not a deterent to its use at all possible places of entry.

Another object of this invention is to provide a novel security device which may be used with a wide variety of movable objects so as to provide both a stop and an alarm function.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWING

The present invention may be more readily described by reference to the accompanying drawing in which.

Figure 1:
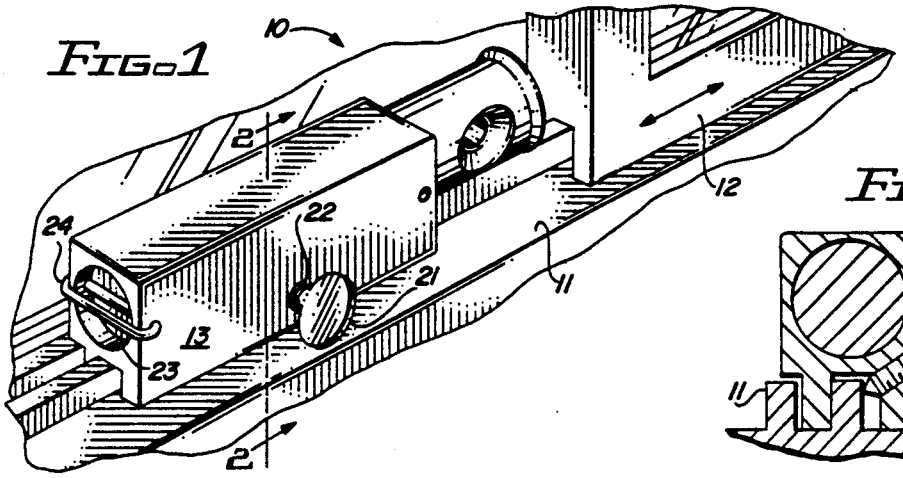
FIG. 1 is a perspective view of a security device mounted on the rail of a sliding or wheel mounted door or window and embodying the invention.
Figure 2:
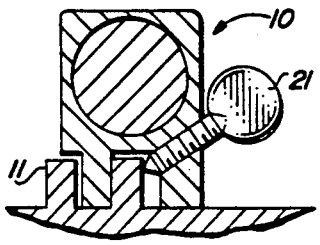
FIG. 2 is a cross sectional view of FIG. 1 taken along the line 2—2.

It should be noted from the drawing that housing 13 comprises a hollow configuration with sound generator 17 telescopically mounted on the container and extending outwardly from the discharge end of the housing with the discharge end of the housing being either one of its ends.

Figure 3:
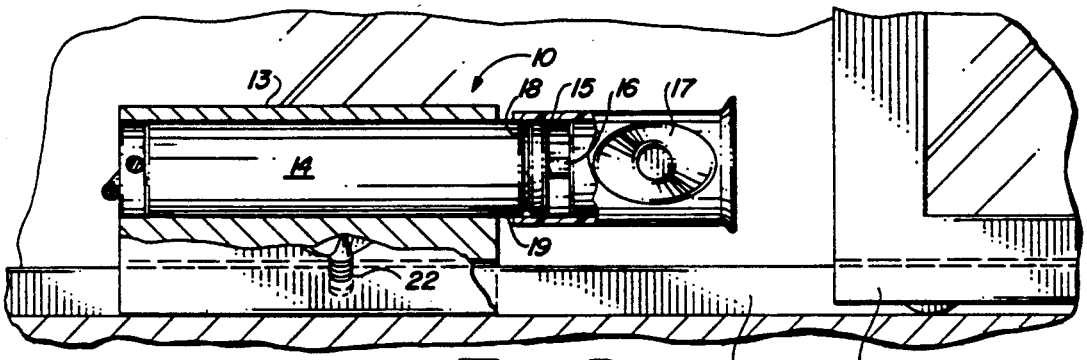
Figure 4:
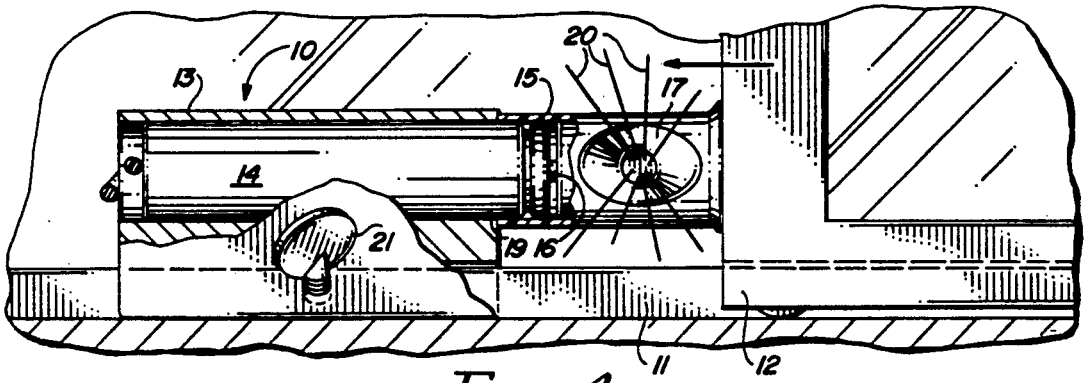

FIG. 3 is a cross sectional view of FIG. 1 showing the security device spaced from the movable window; and FIG. 4 is a cross sectional view similar to FIG. 3 with the movable window or door in contact with the security device.

DESCRIPTION OF THE PREFERRED EMBODIMENT

Referring more particularly to the drawing by characters of reference, FIGS. 1–4 disclose a security device 10 mounted on a rail 11 of a reciprocally movable door or window 12.

The security device comprises a hollow housing 13 containing a removable canister 14 filled with a suitable gas under pressure. Such a container or canister may comprise a conventional container holding a pressurized gas which is readily available from commercial sources and is used to hold aerosols to dispense shaving cream, food, cosmetics and the like. The gas could be air or Freon or any other suitable pressurized gas.

Provided at the end of and within the canister is a normally closed valve 15 for maintaining the pressurized gas in the canister until the valve is actuated to an open position. This valve 15 may be any one of the well known valves used on the commercially available canisters one of which is shown in U.S. Pat. No. 3,299,960 and which valve and actuator are incorporated herein by reference. A valve actuator in the form of a plunger 16 is designed to engage valve 15 when actuated and is normally urged outwardly of canister 14 by a spring (not shown) mounted within the canister. The plunger which may be hollow is mounted adjacent to and may engage one end of a sound generator 17.

The sound generator is in the form of a cylinder the open end 18 of which slides over the valve containing end 19 of canister 14. Plunger 16 is designed to move inwardly of the canister under action of door or window 12 to open valve 15 causing gas under pressure in canister 14 to flow through the plunger and into and through the sound generator causing it to generate an audible sound 20.

It should be noted that the base of housing 13 may be contoured for slidably mounting on or formed to fit and ride longitudinally on rail 11 and is selectively clamped at any suitable place thereon by a clamp 21. Clamp 21 comprises a wing head threaded screw or bolt which is threaded to extend through an internally threaded hole 22 in housing 13 and into contact with rail 11. Tightening down on clamp 21 firmly positions security device 10 at any selected place along rail 11.

Thus, when door or window 12 is moved by an unauthorized person, the door or window will engage sound generator 17 causing it to move against and move plugger 16 inwardly of canister 14. This action releases gas under pressure in canister 14 causing it to flow through plunger 16 and sound generator 17 resulting in an alarm 20. Withdrawal of the door or window from the sound generator housing will cause the valve in canister 14 to close and the alarm to shut off.

It should be noted that housing 13 is open ended with an aperture 23 provided at the left end thereof so that the sound generator engaging end of the canister 14 may extend out of the left end of the housing. To accomplish this feature clamp 24 is removed from the left end of housing 13, as shown in FIG. 1, and placed at the other or right end of the housing and used in the same manner as shown at the left end of the device.

If the disclosed security device is positioned on and fixed to the rail snugly against a sliding door or window, the door or window can not be lifted up and out of the rail without causing the alarm of the security device to be actuated.

Although but one embodiment of the invention has been shown and claimed, it will be apparent to those skilled in the art that various changes and modifications may be made therein without departing from the spirit of the invention or from the scope of the appended claims.

What is claimed is:

1. A security device for attachment to doors or windows to prevent the opening thereof and to sound an alarm in the event an unauthorized opening is attempted comprising:

a container of pressurized gas having a discharge end, a normally closed valve at said discharge end, a valve actuator extending from said valve, a gas actuated sound generator movably mounted on said discharge end of said container and engageable with said valve actuator, an elongated housing means comprising a first housing containing said container, and a second housing containing said valve actuator, the bottom of said housing means being contoured for selective slidable movement on a rail of the door or window to one of a plurality of preselected positions on the rail, and means for selectively clamping said housing means to one of the preselected positions on the rail.

2. The security device set forth in claim 1 wherein:

said valve is mounted in said discharge end of said container, and said valve actuator comprises a plunger extending outwardly of said discharge end of said container for longitudinal movement by the door or window when it is moved along the associated rail and into contact with said sound generator;

thereby causing said plunger to open said valve causing gas under pressure to flow through said generator to actuate the alarm.

3. The security device set forth in claim 1 wherein:

said means for selectively clamping said housing means comprises a threaded bolt extending through an internally threaded aperture in said housing means for clampingly engaging the rail.

4. The security device set forth in claim 1 wherein:

said second housing comprises a hollow configuration which together with said sound generator is selectively slidable over said discharge end of said container.

5. The security device set forth in claim 1 wherein:

said housing means comprises a hollow open ended configuration with said discharge end comprising either end of said housing.

* * * * *